US009756885B1

(12) United States Patent
Williams et al.

(10) Patent No.: US 9,756,885 B1
(45) Date of Patent: Sep. 12, 2017

(54) RELAY RACE GLOVES

(71) Applicants: Byron Williams, Fort Worth, TX (US); Darryl Lewis, Fort Worth, TX (US)

(72) Inventors: Byron Williams, Fort Worth, TX (US); Darryl Lewis, Fort Worth, TX (US)

( * ) Notice: Subject to any disclaimer, the term of this patent is extended or adjusted under 35 U.S.C. 154(b) by 0 days.

(21) Appl. No.: 15/163,261

(22) Filed: May 24, 2016

(51) Int. Cl.

| | |
|---|---|
| ***G08B 1/08*** | (2006.01) |
| ***A41D 19/00*** | (2006.01) |
| ***A41D 1/00*** | (2006.01) |
| ***G08B 3/10*** | (2006.01) |

(52) U.S. Cl.
CPC ..... *A41D 19/0031* (2013.01); *A41D 1/002* (2013.01); *A41D 19/0048* (2013.01); *G08B 3/10* (2013.01)

(58) Field of Classification Search
CPC .... A63B 2024/0034; A63B 2024/0096; A63B 2071/0638; A63B 2220/40; A63B 2220/803; A63B 2220/833; A63B 2225/50; A63B 24/0087; A63B 43/00; A63B 71/0622; A63F 2300/69; F42B 10/14; F42B 12/60
USPC ..... 340/533, 527, 506, 525, 539.13, 539.22, 340/566, 691.2, 691.6, 692, 3.23, 3.22
See application file for complete search history.

(56) References Cited

U.S. PATENT DOCUMENTS

| | | | | |
|---|---|---|---|---|
| 4,281,389 | A * | 7/1981 | Smith | A41D 19/0027 2/160 |
| 5,509,809 | A | 4/1996 | Clay | |
| 6,913,559 | B2 | 7/2005 | Smith | |
| 7,562,572 | B2 | 7/2009 | You | |
| D659,912 | S | 5/2012 | Tesfaye | |
| 8,221,291 | B1 | 7/2012 | Kantarevic | |
| 8,572,764 | B2 | 11/2013 | Thellmann | |
| 8,928,464 | B2 | 1/2015 | Claver | |
| 2003/0026170 | A1* | 2/2003 | Yang | G04C 3/005 368/10 |
| 2009/0019618 | A1* | 1/2009 | Winningham | A41D 19/01523 2/161.1 |
| 2011/0138517 | A1* | 6/2011 | Ambrosio | A41D 19/0024 2/160 |
| 2013/0283497 | A1* | 10/2013 | Tamaribuchi | A41D 19/01547 2/159 |
| 2014/0287807 | A1* | 9/2014 | Cohen | A63F 13/00 463/7 |
| 2014/0295757 | A1* | 10/2014 | Kubota | H04N 5/232 455/41.1 |

FOREIGN PATENT DOCUMENTS

WO 2004089213 A1 10/2004

* cited by examiner

*Primary Examiner* — Daniel Previl

(57) ABSTRACT

The relay race gloves are provided to each runner participating in the relay race. That being said, there are a plurality of relay race gloves included, and each relay race glove is able to detect the presence of one another via a contact sensor. The contact sensor is ideally provided on a palm surface of the respective relay race glove such that during a relay race the two runners would simply touch each others hands in a manner consistent with a palm-to-palm clap in order for the contact sensors to detect one another, and initiate an alarm sequence. Each relay race glove includes a processing member that is wired to the contact sensor. The processing member is also wired to a transmitter, a receiver, a powering member, and a speaker.

2 Claims, 4 Drawing Sheets

RELAY RACE GLOVES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of athletics, more specifically, track and field relay races where two or more relay racers wear a glove that is able to initiate an alarm when two successive runners contact one another via their respective glove.

In traditional relay races, a baton is handed off from one runner to the next while both runners are within a set zone so that he/she may proceed to the next phase of the relay race. In some cases, the baton can leave the grip of a runner causing interruption to the runner's pace if/when they try to retrieve the baton in order to proceed in the race. By eliminating the use of a baton, the relay race gloves provide a new advantageous way for each runner's racing responsibility to changeover within the set handoff/transition zone. When using the relay race gloves, the runner is enabled to focus his/her energy more on running speed versus the traditional tasks that occur in a relay race where a runner must disburse their focus and energy amongst speed, handing off and receiving a baton, and the overall handling of a baton itself while running.

SUMMARY OF INVENTION

The relay race gloves are provided to each runner participating in the relay race. That being said, there are a plurality of relay race gloves included, and each relay race glove is able to detect the presence of one another via a contact sensor. The contact sensor is ideally provided on a palm surface of the respective relay race glove such that during a relay race the two runners would simply touch each others hands in a manner consistent with a palm-to-palm clap in order for the contact sensors to detect one another, and initiate an alarm sequence. Each relay race glove includes a processing member that is wired to the contact sensor. The processing member is also wired to a transmitter, a receiver, a powering member, and a speaker.

It is an object of the invention to provide a relay race runner with relay race gloves that communicates to each runner when their hands touch so as to replace the need for a baton, and provide an audible alarm when one runner can start his/her portion of the relay race.

It is a further object of the invention to provide relay race gloves adapted with audible sound to be used in place of a baton.

It is a further object of the invention to provide relay race gloves adapted with a processing member that can record and wirelessly transmit signals indicating that another relay race glove has contacted the respective relay race glove.

This together with additional objects, features, and advantages the relay race gloves will be readily apparent to those of ordinary skill in the art upon reading the following detailed description of the presently preferred, but nonetheless illustrative, embodiments when taken in conjunction with the accompanying drawings.

In this respect, before explaining the current embodiments of the relay race gloves in detail, it is to be understood that the relay race gloves are not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the relay race gloves.

It is therefore important that the claims be regarded as including such equivalent construction insofar as they do not depart from the spirit and scope of the relay race gloves. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
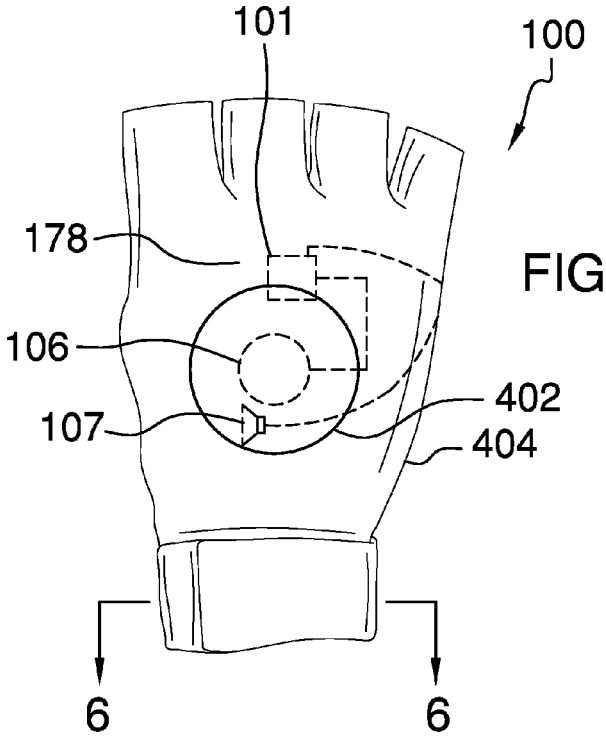
FIG. 1 is a top view of an embodiment of the disclosure.
Figure 2:
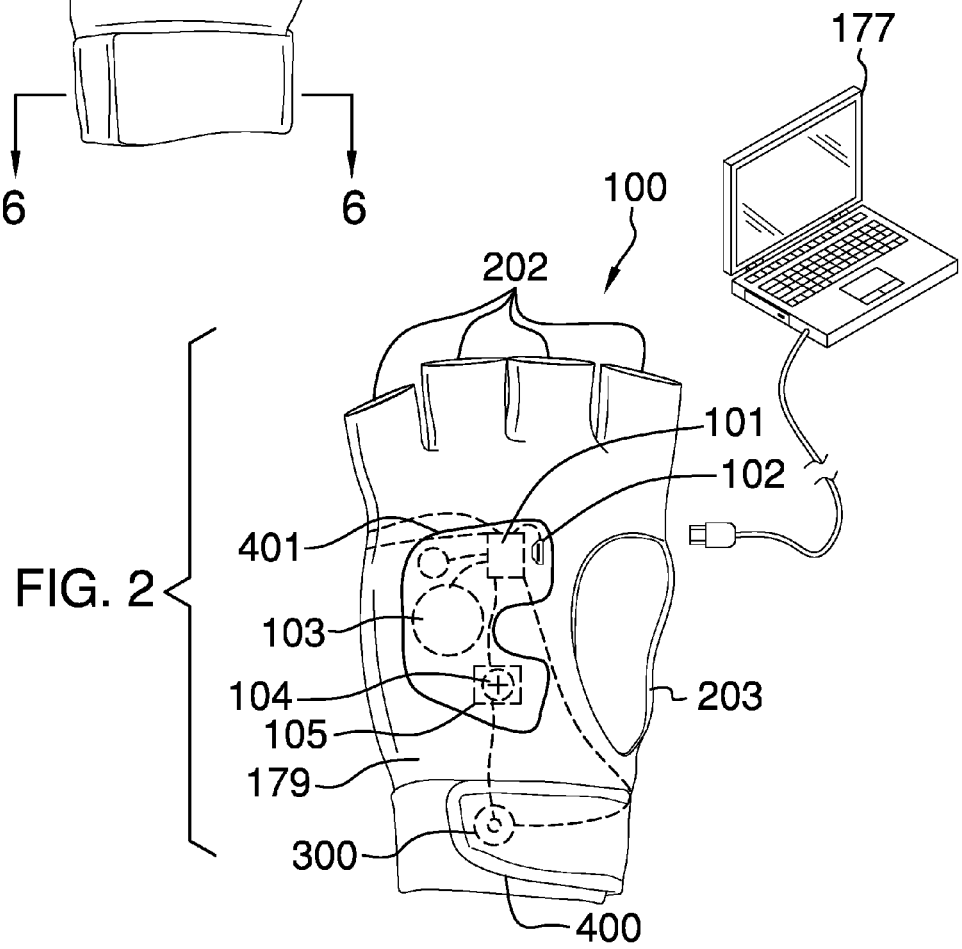
FIG. 2 is a bottom view of an embodiment of the disclosure.
Figure 3:
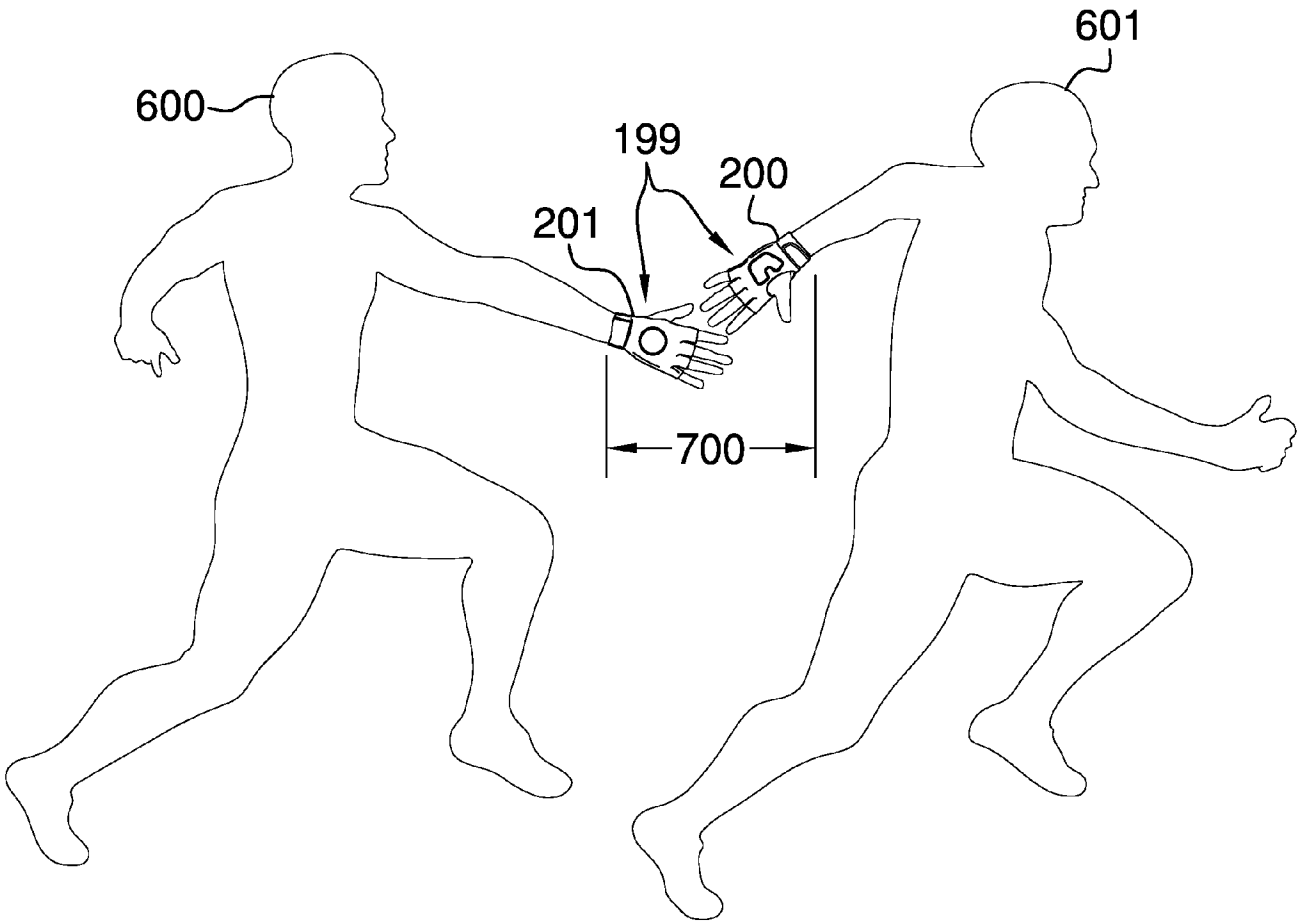
FIG. 3 is a view of an embodiment of the disclosure in use.
Figure 4:
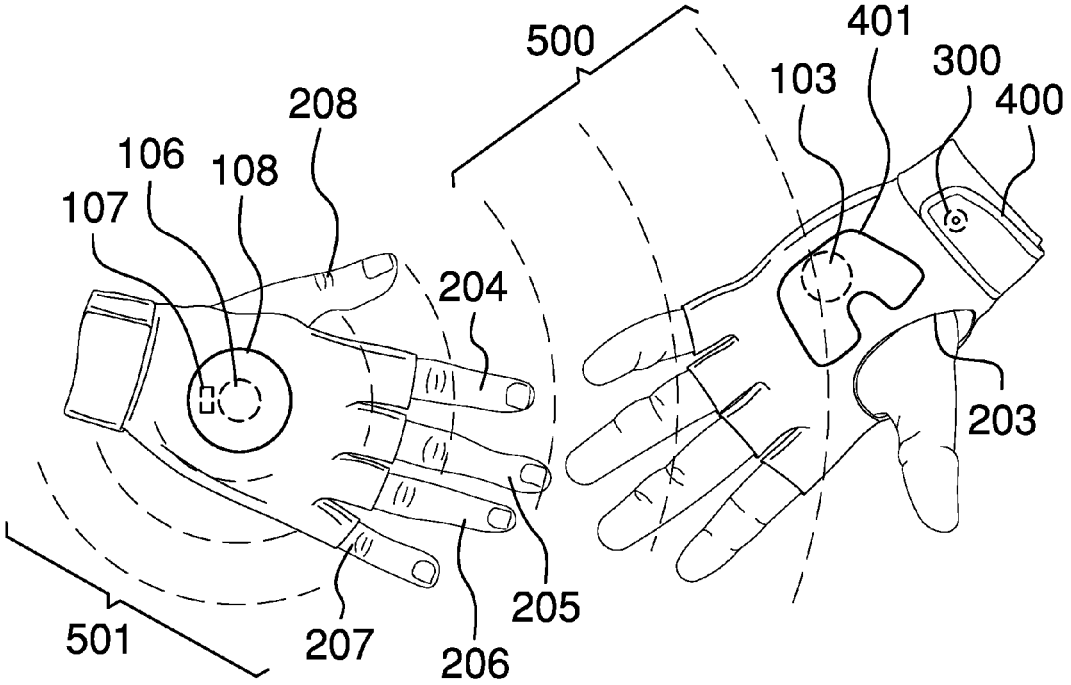
FIG. 4 is another view of an embodiment of the disclosure in use.
Figure 5:
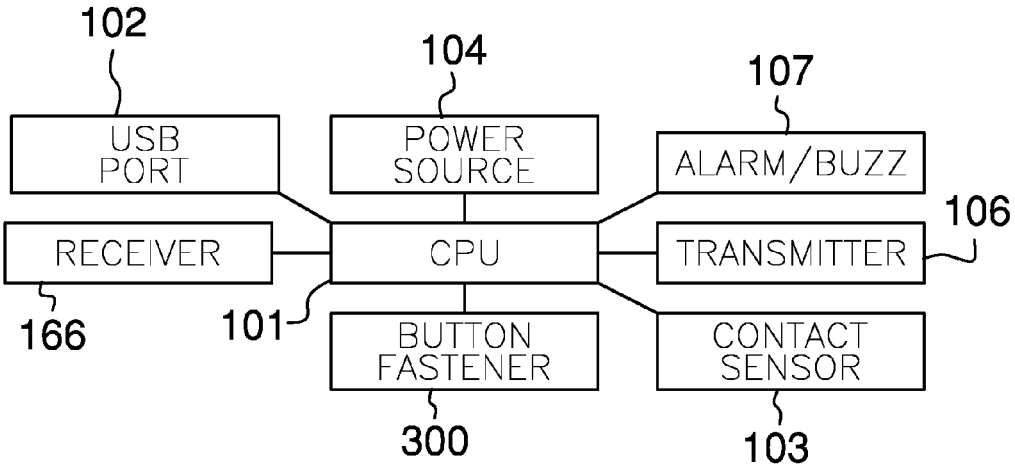
FIG. 5 is a block diagram of componentry associated with an embodiment of the disclosure.
Figure 6:
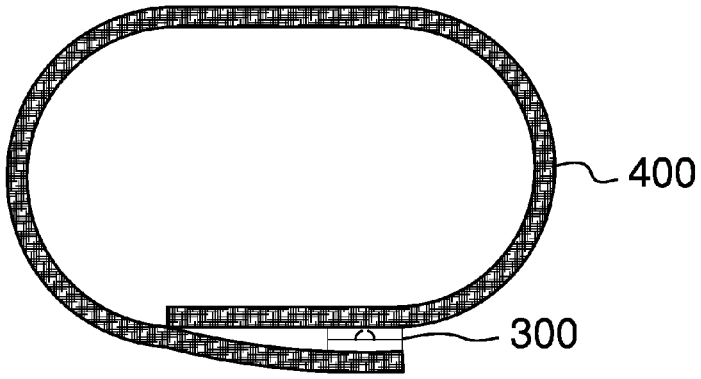
FIG. 6 is a cross-sectional view of an embodiment of the disclosure along line 6-6 in FIG. 1.

Detailed reference will now be made to a first potential embodiment of the disclosure, which is illustrated in FIGS. 1 through 6, in the form of relay race gloves 100 (hereinafter invention), and which includes a plurality of fitted gloves 199. The plurality of gloves 199 may be further defined as at least one left-handed glove 200 and at least one right-handed glove 201. The plurality of gloves 199 are constructed of materials consisting of, but not limited to, leather, vinyl, lamb skin, nylon, and/or cotton. Both the left hand fitted glove 200 and right hand fitted glove 201 have finger sleeves 202, which is adapted to expose a portion of a person's index finger 204, middle finger 205, ring finger 206, and small finger 207. The left hand fitted glove 200 and right hand fitted glove 201 both have thumb openings 203. The thumb opening 203 is adapted to expose a portion of a person's thumb finger 208. The left hand fitted glove 200 may be referred to as a left hand glove 200; whereas the right hand fitted glove 201 may also be referred to as a right hand glove 201.

The left hand glove 200 and right hand glove 201 each include at least one battery 104 that is fitted in a battery compartment 105. At least one battery 104 provides electrical needs to a CPU 101, a contact sensor 103, a transmitter 106, a sound-transmitting device 107, and a receiver 166. The at least one battery 104 is in direct connection to a button fastener 300 which acts as an on/off switch when fastened/unfastened by opening and closing the negative circuit from between the at least one battery 104 and the CPU 101.

The button fastener 300 is located on a wrist strap 400. At least one USB port is in direct connection to the CPU 101, which is in direct connection to at least one battery 104. At least one USB port 102 is intended to be used to recharge the at least one battery 104 and also allow for a personal computer 177 to connect to the CPU 101.

Located on a top side 178 of both the left hand glove 200 and right hand glove 201 is the transmitter chip 106 and the sound transmitting device 107. The top side 178 of the left hand glove 200 and the right hand glove 201 is opposite of a palm side 179. The transmitter chip 106 and the sound transmitting device 107 are fitted within a first compartment 402 that is affixed to the top side 178 of both the left hand glove 200 and the right hand glove 201. The transmitter chip 106, the receiver 166, and the sound transmitting device 107 are part of a direct circuit with the CPU 101.

Located on the palm side 179 of the left hand glove 200 and the right hand glove 201 is a palm pad compartment 401 that contains the CPU 101, the USB port 102, the at least one battery 104, the battery compartment 105, the contact sensor 103, and the receiver 166.

When the relay race gloves 100 are in use, at least two runners will wear at least one of the relay race gloves 100. When in use, a first runner 600 will proceed towards a second runner 601. As the first runner 600 approaches the second runner 601 in motion, the first runner 600 will extend his/her right hand glove 201 forward towards the left hand glove 200 of the second runner 601 who will be reaching back towards the first runner 600 (see FIG. 3).

The transmitter 106 located within the right hand glove 201 being worn by the first runner 600 provides a digital signal 500 that is to be received via the receiver 166 located within the second runner's 601 left hand glove 200 when both the right hand glove 201 and left hand glove 200 reach a set distance 700. When the contact sensors 103 of the right hand glove 201 and the left hand glove 200 actually touch, the sound transmitting device 107 will make an audible sound 501 signaling a second runner 601 that he/she may proceed to the next phase of the race. The sound transmitting device 107 is also known as a speaker.

It shall be noted that the use of the transmitter 106 and the receiver 166 in concert with the contact sensor 103 provides a double-level system of accuracy. This double-level system of accuracy would prevent an unintended alarm from being generated simply because a contact sensor is contacted with another object, much less a glove worn by another runner. Moreover, the first runner 600 and the second runner 601 would be members of a team participating in the relay race. The use of the digital signal 500 amongst the transmitter 106 and the receiver 166 of corresponding gloves is a first sequence, and the actual touching of the contact sensors 103 from the two respective gloves is a second sequence.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A set of relay race gloves comprising:

a plurality of gloves adapted to be worn on a hand of all runners for a relay race; wherein during said relay race, successive runner's hands touch one another via the plurality of gloves;

wherein the plurality of gloves initiate an audible alarm upon detection of contact between the plurality of gloves that touch one another during the relay race;

wherein the plurality of gloves is further defined as at least one left hand glove and at least one right hand glove;

wherein both the at least one left hand glove and the at least one right hand glove have finger sleeves, which is adapted to expose a portion of a person's index finger, middle finger, ring finger, and small finger;

wherein the at least one left hand glove and the at least one right hand glove have a thumb opening; wherein the thumb opening is adapted to expose a portion of a person's thumb finger;

wherein the at least one left hand glove and the at least one right hand glove each include at least one battery that is fitted in a battery compartment;

wherein the at least one battery provides electricity for a central processing member;

wherein the central processing unit is in wired connection with a contact sensor, a transmitter, a sound-transmitting device, and a receiver;

wherein the at least one battery is in direct connection to a button fastener;

wherein the button fastener is an on/off switch that when fastened forms a circuit between the central processing unit and the at least one battery;

wherein the at least one left hand glove and the at least one right hand glove includes a wrist strap;

wherein the button fastener is located on the wrist strap;

wherein at least one USB port is in direct connection to the central processing unit, which is in direct connection to at least one battery;

wherein the at least one USB port enables recharging of the at least one battery and also allow for a personal computer to connect to the central processing unit;

wherein the at least one left hand glove and the at least one right hand glove is further defined with a top side and a palm side;

wherein the top side is opposite of the palm side;

wherein located on the top side is the transmitter chip and the sound transmitting device;

wherein the transmitter chip and the sound transmitting device are fitted within a first compartment that is affixed to the top side;

wherein the transmitter chip, the receiver, and the sound transmitting device are part of a direct circuit with the central processing unit;

wherein located on the palm side is a palm pad compartment that contains the central processing unit, the at least one USB port, the battery compartment including the at least one battery, the contact sensor, and the receiver;

wherein a first runner dons one of the at least one right hand glove;

wherein a second runner dons one of the at least one left hand glove;

wherein the first runner proceeds towards the second runner;

wherein as the first runner approaches the second runner whilst in motion, the first runner extends the one of the at least one right hand glove forward towards the one of the at least one left hand glove of the second runner who will be reaching back towards the first runner;

wherein the transmitter located within the one of the at least one right hand glove being worn by the first runner provides a digital signal that is to be received via the receiver located within the second runner's one of the at least one left hand glove when both the right hand glove and left hand glove reach a set distance.

2. The set of relay race gloves as described in claim 1 wherein once the contact sensors of the one of the at least one right hand glove and the one of the at least one left hand glove touch, the sound transmitting device will make an audible sound signaling the second runner to proceed to a next phase of the relay race.

* * * * *